US005914659A

United States Patent [19]

Herman et al.

[11] Patent Number: 5,914,659

[45] Date of Patent: Jun. 22, 1999

[54] CHILD'S SHOE FIT SENSOR

[76] Inventors: Edie Herman; Michael Madison, both of 1122 Ruth Pl., North Bellmore, N.Y. 11710

[21] Appl. No.: 08/921,746

[22] Filed: Aug. 27, 1997

[51] Int. Cl.[6] ..... G08B 23/00

[52] U.S. Cl. ..... 340/573; 340/665; 340/666; 340/693; 600/592; 73/172

[58] Field of Search ..... 340/573, 665, 340/666, 323 R, 691, 693; 600/592; 33/3 B, 3 C; 73/172; 12/126, 8.8; 607/144

[56] References Cited

U.S. PATENT DOCUMENTS

| | | | |
|---|---|---|---|
| 2,399,424 | 2/1946 | Bliss | 378/192 |
| 3,757,418 | 9/1973 | Stiebel | 33/3 C |
| 3,834,029 | 9/1974 | Stiebel | 33/3 C |
| 3,931,680 | 1/1976 | Greensides | 33/3 B |
| 4,000,535 | 1/1977 | Barton | 12/126 |
| 4,064,641 | 12/1977 | Levine | 36/1.5 |
| 4,294,014 | 10/1981 | Baumann et al. | 33/3 C |
| 4,317,293 | 3/1982 | Sigle et al. | 36/43 |
| 4,395,826 | 8/1983 | Bidegain et al. | 33/3 C |
| 4,538,353 | 9/1985 | Gardner | 3/33 C |
| 4,578,866 | 4/1986 | Bruemmer | 33/3 B |
| 4,604,807 | 8/1986 | Bock et al. | 33/3 C |
| 4,635,366 | 1/1987 | Fohrman et al. | 33/3 B |
| 4,653,133 | 3/1987 | Giebel | 12/8.8 |
| 4,931,773 | 6/1990 | Rosen | 340/573 |
| 5,025,476 | 6/1991 | Gould et al. | 382/115 |
| 5,033,291 | 7/1991 | Podoloff et al. | 73/172 |
| 5,123,169 | 6/1992 | White et al. | 33/6 |
| 5,156,150 | 10/1992 | Lary | 600/310 |
| 5,164,793 | 11/1992 | Wolfersberger et al. | 356/376 |
| 5,168,264 | 12/1992 | Agustin | 340/573 |
| 5,231,723 | 8/1993 | White et al. | 12/133 R |
| 5,253,654 | 10/1993 | Thomas et al. | 600/592 |
| 5,323,650 | 6/1994 | Fullen et al. | 73/172 |
| 5,408,764 | 4/1995 | Wut | 36/137 |
| 5,449,002 | 9/1995 | Goldman | 600/592 |
| 5,500,635 | 3/1996 | Mott | 340/323 R |
| 5,515,268 | 5/1996 | Yoda | 705/26 |
| 5,539,677 | 7/1996 | Smith | 705/26 |

*Primary Examiner*—Benjamin C. Lee
*Attorney, Agent, or Firm*—Alfred M. Walker

[57] ABSTRACT

A shoe size fit sensor indicates by a perceptible alarm that the shoe of an infant, a toddler or other small child is too tight for wear. The shoe fit sensor sets off a perceptible visual and or audible alarm when a child's toe makes constant with the sensor when the shoe is too tight. To avoid false alarms when the child kicks with the shoe, a time delay is provided so that incidental touching of the sensor by momentary kicks does not set off the constant alarm. The sensor also determines when a sock is "bunched up" in the toe area, and distinguishes this condition from a condition where constant contact by a portion of the child's foot indicates that the shoe is too tight.

17 Claims, 4 Drawing Sheets

CHILD'S SHOE FIT SENSOR

FIELD OF THE INVENTION

The present invention relates to a sensor which can indicate by a perceptible alarm that the shoe of an infant, a toddler or other small child is too tight for wear.

BACKGROUND OF THE INVENTION

Small children outgrow shoes very quickly and often do not realize that they are wearing shoes that are too tight. Although parents try to assess the situation, the child does not always cooperate; the parents sometimes overcompensate by buying new shoes thinking the old ones are too tight when the fit is still good. It would be desirable to have shoes that would objectively indicate the condition of being too tight.

For amusement and/or safety purposes, some children's shoes are equipped with lights that flash on and off as they walk or run. U.S. Pat. No. 5,408,764 of Wut discloses a motion activated light module fitted in the heel of such shoes. While the light emitting diodes (LED's) used could be used for indicating that the shoes are too tight, they are not used for this purpose by Wut '764. U.S. Pat. No. 5,033,291 of Podoloff et al. discloses a flexible tactile sensor for measuring foot bottom pressure. Using pressure-sensitive resistive material between two orthogonal layers of electrodes, the resistance at each electrode intersection can be used to infer the pressure of the bottom of the foot against the support layer of a shoe or orthotic appliance. External electronics is then used to map the foot bottom pressure; this, in turn, can be used to modify or improve orthotics or special shoes for people with problem feet. This technology is too sophisticated for the current application since the only information required is that a tightness threshold has been exceeded.

OBJECTS OF THE INVENTION

Therefore, the objects of the present invention are as follows:

It is an object of the present invention to provide a child's shoe that monitors the tightness of fit and indicates when a threshold has been exceeded.

A further object of this invention is to monitor the tightness at the sides at the widest part of the foot.

Another object of this invention is to monitor the fit of the front of the shoe against the tip of the large toe.

Yet another object of this invention is to indicate the "too tight" conditions via one or more light emitting diodes and/or an audio signal form a module housed in the heel of the shoe.

A further object of this invention is to provide differentiation in indication for snug toe versus a tight width. Yet another object of this invention is to introduce an electrical delay in the indication to eliminate false triggering due to momentary foot/shoe stress (as in kicking a ball).

Another object of this invention is to implement this feature inexpensively and to have the battery last the normal lifetime of the shoe.

SUMMARY OF THE INVENTION

In keeping with these objects and others which may become apparent, the present invention relates to a shoe fit sensor which sets off a perceptible visual and or audible alarm when a child's toe makes constant contact with the sensor when the shoe is too tight. In order to avoid false alarms when the child kicks with the shoe, a time delay is provided so that incidental touching of the sensor by momentary kicks does not set off the constant alarm. The sensor also determines when a sock is "bunched up" in the toe area, and distinguishes this condition from a condition where constant contact by a portion of the child's foot indicates that the shoe is too tight.

BRIEF DESCRIPTION OF THE DRAWINGS

The present invention can best be understood in conjunction with the accompanying drawings, in which.

DETAILED DESCRIPTION OF THE DRAWINGS

An electrical approach is taken to sensing a "too tight" condition and indicating the condition via light emitting diodes (LED's). Momentary push button switches covered by resilient foam pads are used to sense the force of the foot against the side and front of the shoe. The degree of stiffness and the thickness and placement of the pads along with the resilience of the outer shoe material determine the threshold level which closes a switch.

Figure 1:
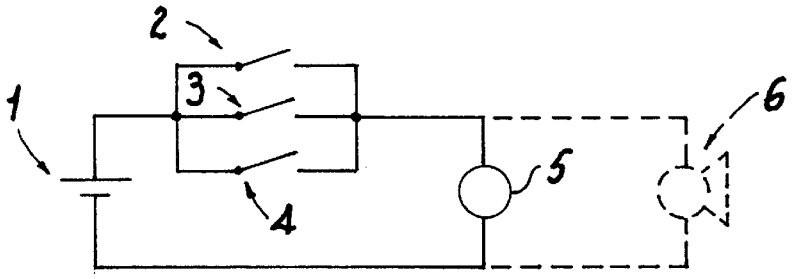
FIG. 1 is a schematic diagram of the basic invention.

FIG. 1 shows the most simple circuit where the toe switch 2 and the two side switches 3 and 4 are all wired in parallel. Any one or more of these normally open switches would turn on LED 5 as supplied by battery 1. It is recommended that the battery 1 be a one cell lithium type such as the Panasonic CR2032 which has a 220 mah capacity which should last the life of the shoe. Note that no standby current is drawn by this circuit. LED 5 should be a self flashing type such as Industrial Devices Inc. type 5120F1. This type of LED flashes at a frequency of 1.5 to 2.5 Hz from a voltage as low as 2.0 volts. If desired, a piezoelectric buzzer 6 with built-in electronics can be substituted for LED 5 or just wired in parallel as shown to sound an alarm whenever the LED is on. An International Components Corp. model BRPI408P-12-CS can be used.

Figure 2:
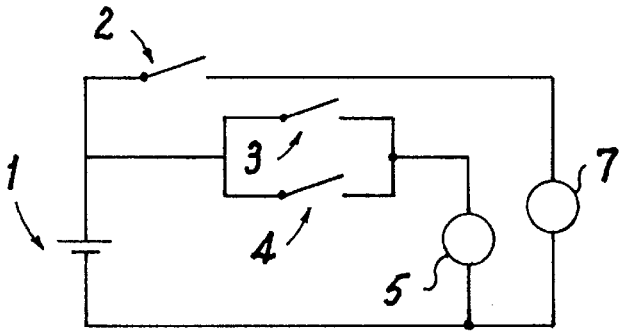
FIG. 2 is a schematic diagram of dual indicator embodiment.

FIG. 2 shows a circuit where toe switch 2 lights its own LED 7 to differentiate the two types of tightness problems. Besides position of the indicator LED'S, they may be of different color. For example, LED 7 for "toe tightness" could be green while LED 5 for "width tightness" could be red. This differentiation could alert the parent to a "bunched-up" sock at the front of shoe, a temporary condition, if only the "toe" indicator of one shoe lights up.

Figure 3:
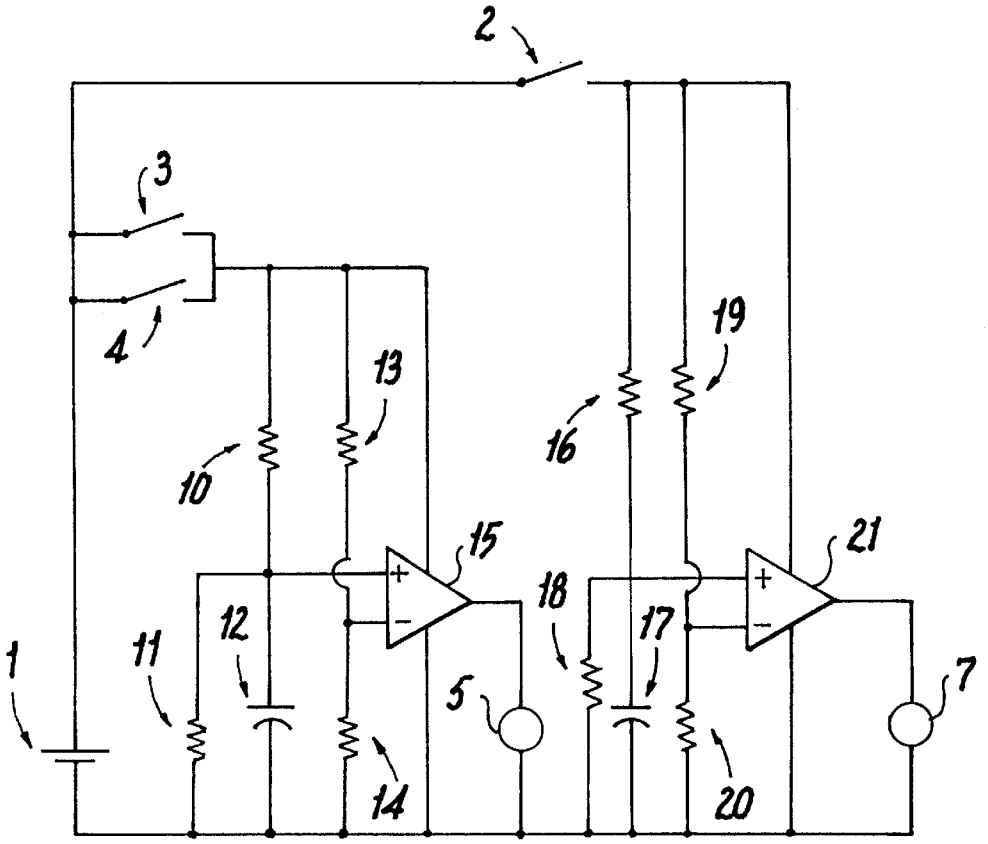
FIG. 3 is a schematic of dual indicator with time delay embodiment.

Although the circuits in FIGS. 1 & 2 work adequately, the indicators may flash occasionally even if the shoe fit is not too tight, however the LED's would not flash continuously unless the tight condition remains constant. To eliminate or reduce the occurrence of such brief indications, the analog circuit of FIG. 3 introduces a turn-on delay which inhibits the indicator unless a switch stays closed for a short duration such as a few seconds. Many variations of this circuit including digital implementations are well known in the art.

In this circuit a dual linear complementary metal oxide semiconductor (CMOS) comparitor module such as a Texas Instruments TLC352CD or equivalent is the key element. One comparitor 15 is used for the "width" circuit while the other identical circuit using comparitor 21 handles the "toe" circuit. Note that this circuit also draws no standby current since the comparitors themselves are powered through the sensor switches. The following explanation is for the "width" circuit: If either switch 3 or 4 closes, power is supplied to comparitor 15. Resistors 13 and 14 form a voltage divider biasing the negative input at a voltage of about +2.5 volts, the nominal voltage of battery 1. A large value resistor 10 starts charging capacitor 12. Resistor 11 is at least ten times the value of resistor 10 so that eventually the voltage at the + input to comparitor 15 will exceed the voltage at the – input thereby switching on comparitor 15 to light blinking LED S. Resistor 11 discharges capacitor 12 slowly when both switches 3 and 4 are off. In this way, if the switches pulse on frequently, the charge on capacitor 12 will not have time to leak away and the "on" delay is minimal (this could indicate a situation of approaching the tightness limit). A delay of about two seconds is achievable with resistor 10 of 10 megohms, resistor 11 of 100 megohms, capacitor 12 of 0.22 microfarad and the voltage at the – terminal of comparitor 15 set at 2.5 volts.

Figure 4:
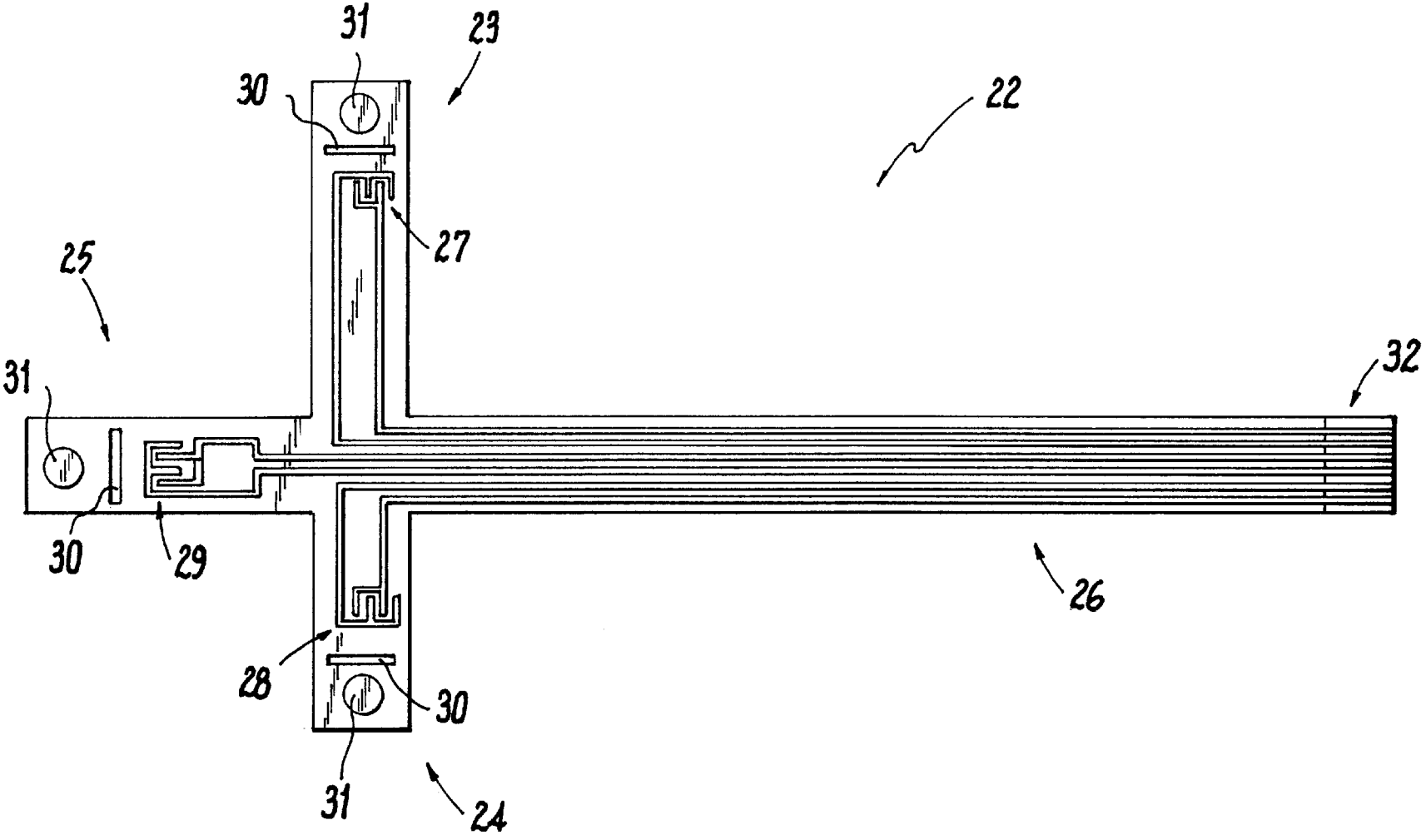
FIG. 4 is a flexible printed circuit switch layout (top view)

The practicality of this invention is determined by the low parts cost and low installation labor of the three switches. A low cost flexible printed circuit integrates the switches (which are themselves "printed" ) with the wiring for easy installation. A single-sided circuit on a low cost polyester substrate with conductive inks is used; one supplier of this technology is PolyFlex Circuits, Inc. of Cranston, R.I. The layout of this switch circuit 22 is shown in FIG. 4. This is a top view for the right shoe. The long tail 26 goes from the heel of the shoe at terminal 32 to the wide section near the front of the shoe. The left side sensor wing is 24 while the right side sensor wing is 23; 25 is the front extension for the toe sensor switch. Wing 23 is longer than 24 because the long tail 26 and the front extension 25 are aligned with the large toe, not with the center of the shoe. The three switches are all similarly formed, 27, 28 and 29. Each switch consists of two fingers interdigited with but separated from two similar fingers. Conductors from these fingers are routed to the connector 32. Outward of these small switch grid patterns, is a tab with a disk shaped conductor region 31. A small slot 30 is cut out of the substrate so that the disk tabs can be easily folded over in registration with the switch grid patterns. It can be appreciated that if a disk 31 is folded over grid pattern 29 and pressed down, the interdigited area will be bridged electrically and the "toe" switch will be electrically closed.

Figure 5:
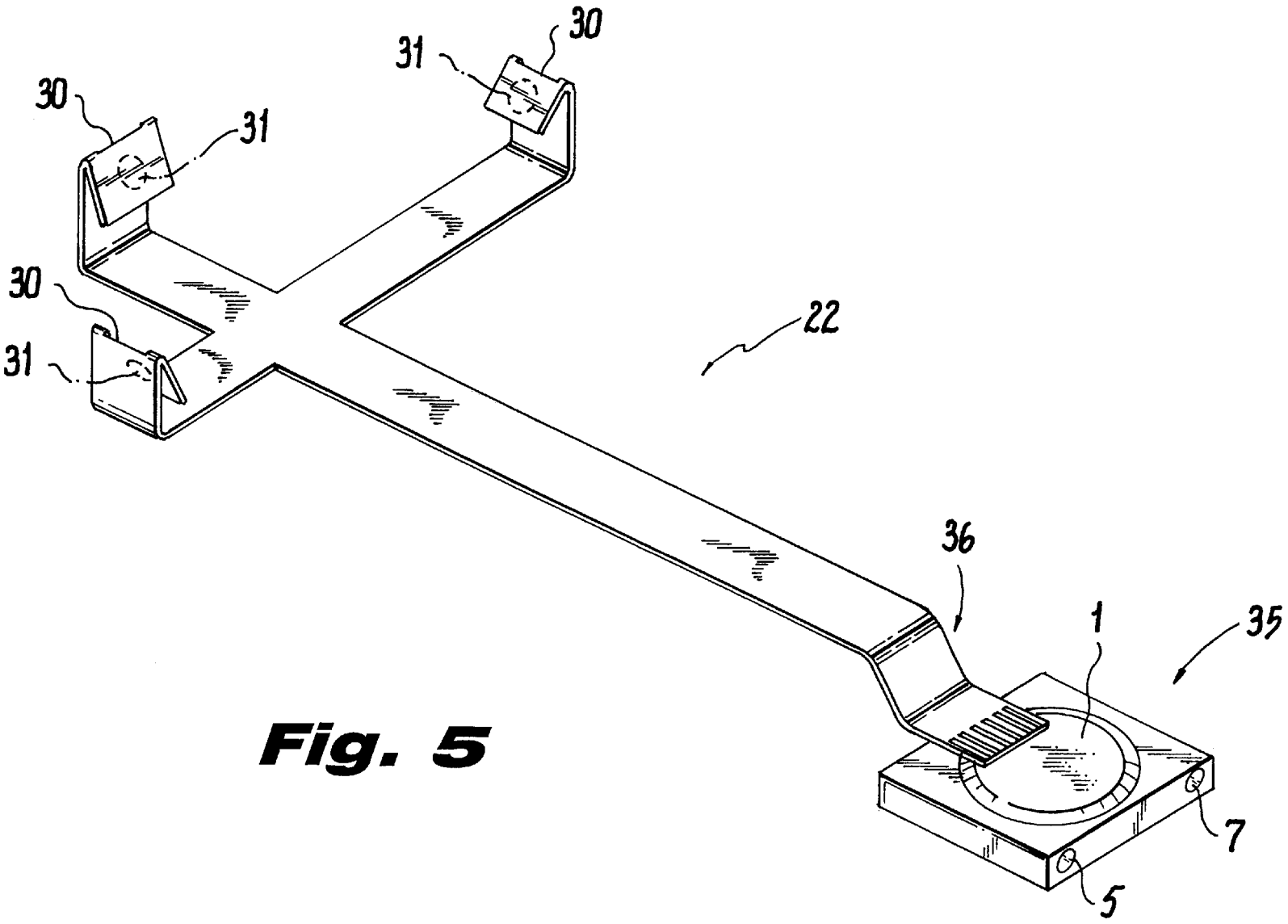
FIG. 5 is an isometric view of printed circuit and indicator module.

FIG. 5 shows an isometric (3-D) view of switch circuit 22 showing how the switch tabs are folded over and how the wings are bent upright to sense side and front pressure. Region 36 is bent slightly to go through a narrow slot in the semi-rigid shoe bottom to communicate and terminate electrically on module 35 which contains battery 1, LED's 5 and 7 and any other circuitry. Module 35 may be encapsulated in transparent epoxy for moisture resistance and shock resistance.

Figure 6:
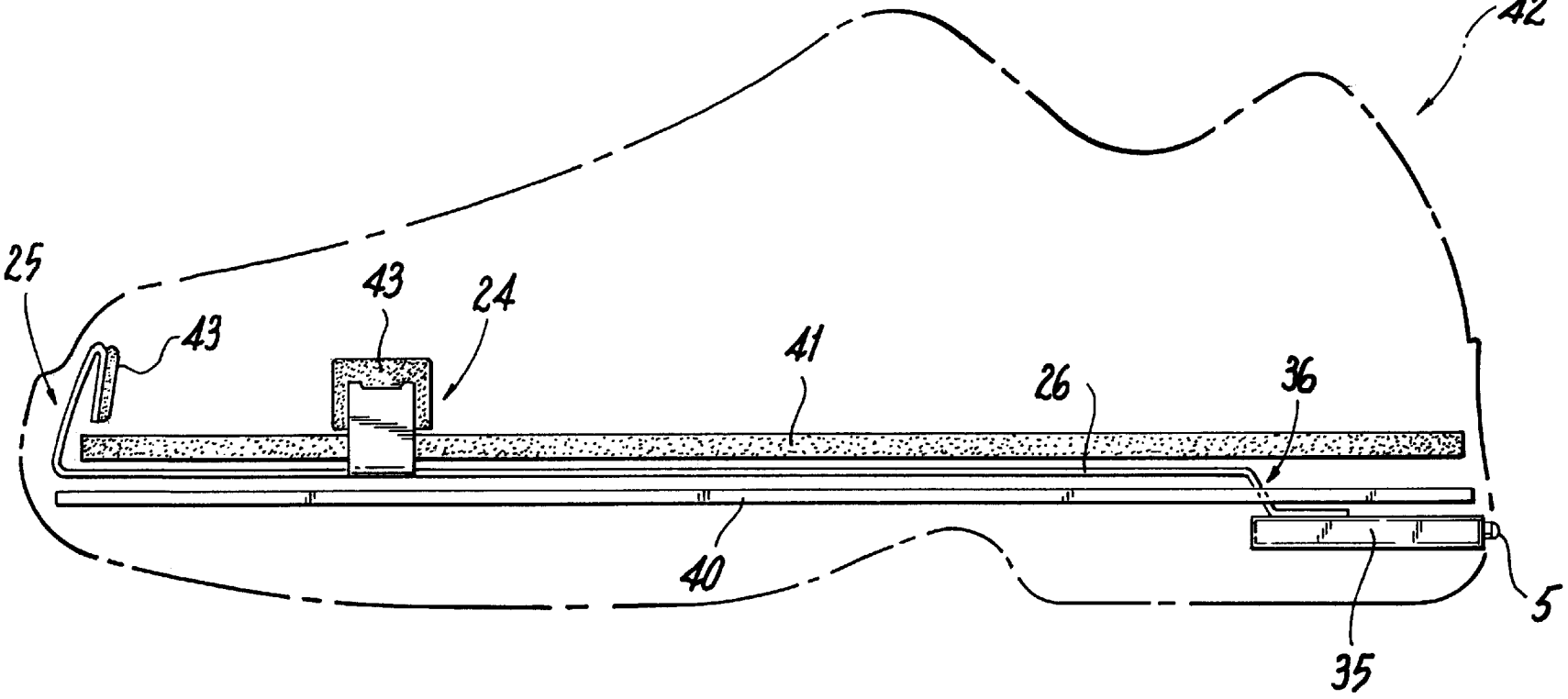
FIG. 6 is a side view of the shoe components with the shoe shown in dotted lines in outline.

FIG. 6 shows a side view of switch circuit 22, semi-rigid bottom layer 40, soft bottom cushion 41 (covering the center of 22), and module 35 in a cavity in the heel of the shoe. A side outline of the shoe in indicated. A self adhesive foam pad 43 over toe switch 29 (front extension 25) is shown in cross section. A similar pad 43 over side extension 24 is shown with the adhesive layer facing the viewer. It would be attached to the inside side of the shoe. These switch pads have shallow recesses to contain the folded over tabs forming the switches. Their consistency along with the elasticity of the shoe material itself determine the threshold levels for indicating "too tight" conditions.

It is further noted that other modifications may be made to the present invention without departing from the scope of the present invention as noted in the appended claims.

I claim:

1. A shoe size fit sensor that indicates by a perceptible alarm that the shoe of an infant, a toddler or other small child is too tight for wear, said sensor comprising;

a sensor located within an inside toe region of a shoe, a power supply connected to said sensor, at least one switch connecting said power supply with said sensor and a perceptible alarm, said sensor responsive to setting off said perceptible alarm when a child's toe makes contact with said sensor when the shoe is too tight, said at least one switch comprising an upwardly extending toe switch responsive to forcible forward or lateral contact from a toe of a foot.

2. The shoe size fit sensor as in claim 1 wherein said perceptible alarm is an audible alarm.

3. The shoe size fit sensor as in claim 1 wherein said sensor includes at least one push button switch covered by at least one resilient pad, said sensor sensing the contact force of the child's toe against the front and side inside toe region of the shoe, wherein said switch of said sensor closes upon constant contact of said force against said switch, said switch thereupon activating said perceptible alarm.

4. The shoe size fit sensor as in claim 1 further comprising a means to avoid false alarms when the child kicks with the shoe, said means comprising a time delay being provided wherein incidental touching of said sensor by momentary contact does not set off said perceptible alarm for a constant extended time period.

5. The shoe size fit sensor as in claim 4 further having a means for determining when a sock is "bunched up" in the toe region of the shoe.

6. The shoe size fit sensor as in claim 1 wherein said perceptible alarm is a visual alarm.

7. The shoe size fit sensor as in claim 6 wherein said visual alarm is a light emitting diode (LED) display.

8. The shoe size fit sensor as in claim 1 further comprising a turn-on delay which inhibits said perceptible alarm unless said at least one switch stays closed for a predetermined duration of time.

9. The shoe size fit sensor as in claim 8, wherein said turn on delay comprises a comparitor responsive to a first resistor forming a voltage divider biasing the negative input at a predetermined voltage and a second resistor charges a capacitor, so that voltage at the positive input will exceed voltage at the negative input, thereby switching on said comparitor to said perceptible alarm, said second resistor discharging said capacitor slowly when said switch is off.

10. The shoe size fit sensor as in claim 8, further comprising a tail extending from the heel of the shoe to a width section at a front of the shoe, said tail having laterally extending wings with respective side switches at distal ends of said wings, said tail ending at a distal toe end with a toe switch, said tail having at a proximal end a circuit module containing said power supply and said perceptible alarm.

11. The shoe size fit sensor as in claim 10, wherein each said switch comprises a resilient bent finger having a conductive pad therein.

12. A shoe size fit sensor that indicates by a perceptible alarm that the shoe of an infant, a toddler or other small child is too tight for wear, said sensor comprising:

a sensor located within an inside toe region of a shoe, a power supply connected to said sensor, at least one switch connecting said power supply with said sensor and a perceptible alarm, said sensor responsively setting off said perceptible alarm when a child's toe makes contact with said sensor when the shoe is too tight, wherein said at least one switch comprises a plurality of switches, wherein one of said plurality of switches is a toe switch responsive to forcible forward contact from a toe and at least one further switch is a side switch responsive to forcible lateral contact from a side area of a foot.

13. A children's shoe size alarm system comprising a child's shoe having therein alarm means for alerting an adult to a tight-fit condition; switch means for electrically triggering the alarm means; battery means for energizing the alarm means; sensor means for sensing a tight-fit condition; and delay means for delaying alarm triggering for a preselected time interval, where the alarm means comprises a battery wired to at least one light-emitting diode (LED) where battery current to the at least one LED is controlled by the switch means; and where the switch means comprises alternating, spaced-apart interdigitated electrical conductors charged, respectively with positive and negative voltage; and where the sensor means comprises at least one spring having a tab of electrically conducting material thereon for contacting the interdigitated positive and negative switch conductors, and thereby closing the at least one switch; and where the at least one spring maintains the electrically conducting tab in a normally spaced-apart relationship to the interdigitated switch conductors, thereby maintaining a normally open switch condition and a normal standby condition or zero current draw from the battery; and where the sensor means for sensing a tight-fit shoe condition comprises the at least one spring, the spring being contacted and compressed by the foot of the child, thereby closing the switch and triggering the alarm; and where the delay means for delaying alarm triggering for a preselected time interval comprises a circuit having at least one complementary metal oxide semiconductor (CMOS) comparitor, a plurality of electrical resistors of differing electrical resistance values, and at least one capacitor, and a battery, wherein, when power is supplied to the at least one comparitor and at least two resistors form a voltage divider biasing the negative input to the at least one comparitor at a voltage of about +2.5 volts; and further where a large value resistor charges the at least one capacitor and a large-value resistor having a resistance value at least ten times the value of a small value resistor so that eventually the voltage at the positive input to the at least one comparitor 15 exceeds the voltage at the negative input, thereby switching on the at least one comparitor and triggering the shoe size alarm.

14. The device of claim 13 having a single LED and a length sensor and switch being disposed in the shoe interior in the toe area and a pair of switches and sensors for indicating shoe width tightness, the width switches and sensors being disposed at opposite sides of the widest part of the shoe interior; and where where the length and the width switch and sensor means are electrically connected in parallel, the device having a single LED electrically connected in series with the battery so that the any of the switches is capable of illuminating the LED.

15. The device of claim 13 wherein the alarm means comprises two LEDs of different colors disposed on the outside of the shoe for visibility; the two different LED colors being for, respectively, indicating shoe length fit-tightness and shoe width tightness; and where the switch and sensor means comprise one switch and sensor for indicating shoe length tightness, the length switch and sensor being disposed in the shoe interior in the toe area; and where the switch and sensor means further comprises a pair of switches and sensors for indicating shoe width tightness, the width switches and sensors being disposed at opposite sides of the widest part of the shoe interior; and where further the length tightness switch and sensor and length-indicating LED are electrically connected in parallel with the two width sensors and switches and the width-indicating LED.

16. The device of claim 15 having the battery, time delay circuitry and the at least one LED disposed in a modular housing made of a suitably shock-resistant material, the housing being disposed within the heel of the shoe, with LEDs exposed so that the LEDs are visible from the outside of the shoe; and where the battery, time delay circuitry and LEDs being connected to the at least one switch and sensor by wiring extending along and under the foot cushion material of the shoe; and where the length sensor and switch is placed in alignment with the position of the shoe-wearer's big toe, and is thus not necessarily laterally centered in the precise center of the front of the shoe; and further where the at least one sensor is covered with a self-adhesive foam pad to cushion the structure of the sensor and switch and to provide comfort to the wearer.

17. The device of claim 15 wherein the sensor comprises an electrically nonconductive material of suitable flexibility, wherein the nonconductive material is has a base portion and a folded portion which folded portion is provided with a resilient pad and is partially folded over upon the base portion so as to comprise a resilient spring which is compressible by squeezing the folded portion into proximity with the base portion; and wherein the electrically conductive tab is disposed upon the folded portion and in register with the interdigitated switch conductors disposed upon the base portion, for allowing switch-closing electrical contact between the tab and the interdigitated conductors.

* * * * *